US006720852B2

(12) United States Patent
Farrey et al.

(10) Patent No.: US 6,720,852 B2
(45) Date of Patent: Apr. 13, 2004

(54) METHODS AND APPARATUS FOR ACTUATING AND DEACTUATING A SWITCHING DEVICE USING MAGNETS

(75) Inventors: Michael P. Farrey, Freeport, IL (US); Michael G. Marchini, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/228,708

(22) Filed: Aug. 26, 2002

(65) Prior Publication Data

US 2004/0036565 A1 Feb. 26, 2004

(51) Int. Cl.[7] ..... H01H 9/00
(52) U.S. Cl. ..... 335/207; 337/90
(58) Field of Search ..... 335/205–207; 337/41–90, 337–367; 200/81.4

(56) References Cited

U.S. PATENT DOCUMENTS

| | | | | |
|---|---|---|---|---|
| 1,749,392 | A | | 3/1930 | Penn |
| 1,867,756 | A | | 7/1932 | Penn |
| 2,539,259 | A | | 1/1951 | McCabe |
| 2,641,664 | A | | 6/1953 | Knutson |
| 2,782,278 | A | | 2/1957 | Peters |
| 3,171,003 | A | | 2/1965 | Larsen |
| 3,190,988 | A | | 6/1965 | Graham et al. |
| 3,222,474 | A | | 12/1965 | Fasola, Jr. |
| 3,573,698 | A | | 4/1971 | Mitick |
| 3,593,236 | A | | 7/1971 | Beck |
| 3,656,082 | A | | 4/1972 | Beck |
| 3,750,068 | A | | 7/1973 | Hallin |
| 3,869,619 | A | | 3/1975 | Camillo |
| 3,905,003 | A | | 9/1975 | Rosenberg et al. |
| 4,243,967 | A | | 1/1981 | Frank |
| 4,266,211 | A | | 5/1981 | Ulanet |
| 4,274,072 | A | | 6/1981 | Gustafson |
| 4,365,125 | A | * | 12/1982 | Keller ..... 200/81.9 |
| 4,414,520 | A | | 11/1983 | Ruuth |
| 4,748,432 | A | | 5/1988 | Yamada |
| 5,148,142 | A | | 9/1992 | Buckshaw et al. |
| 5,166,657 | A | | 11/1992 | Buckshaw et al. |
| 5,194,842 | A | | 3/1993 | Lau et al. |
| 5,262,752 | A | | 11/1993 | Truong et al. |
| 6,040,749 | A | | 3/2000 | Youngner et al. |
| 6,246,305 | B1 | | 6/2001 | Youngner et al. |

OTHER PUBLICATIONS

Honeywell Inc., "Themostats T87F," publication, Form No. 60–2222–2, S.M. Rev. 4–86.
Honeywell, Inc., "T87F Universal Thermostat," publication, Form No. 60–0830–3, S.M. Rev. 8–93.

* cited by examiner

*Primary Examiner*—Lincoln Donovan
(74) *Attorney, Agent, or Firm*—Kris T. Fredrick

(57) ABSTRACT

An apparatus and method for actuating and deactuating an electro-mechanical switch utilizing an energy-storing actuator is disclosed. An electro-mechanical switch can be configured to include an (internal or external) lever. A first magnet having a first magnetic field thereof is generally located on the (internal or external) lever of the electro-mechanical switch. A second magnet having a second magnetic field thereof is generally located on an energy-storing actuator, such as a bi-metal coil, wherein the second magnetic field of the second magnet opposes the first magnetic field of the first magnet to form an opposing magnetic force thereof in order to actuate and deactuate the electro-mechanical switch.

18 Claims, 2 Drawing Sheets

METHODS AND APPARATUS FOR ACTUATING AND DEACTUATING A SWITCHING DEVICE USING MAGNETS

This application is related to a co-pending and co-owned patent application entitled: "Magnetic Actuation of a Switching Device," U.S. Ser. No. 10/228,177, filed on Aug. 26, 2003.

TECHNICAL FIELD

The present invention generally relates to electro-mechanical switches. The present invention also generally relates to thermostats. In addition, the present invention relates to electro-mechanical switches, which can be adapted for use with thermostats.

BACKGROUND OF THE INVENTION

Electro-mechanical switches are utilized in a variety of industrial, consumer and commercial applications. Certain types of electrical switching applications require a mechanical switch that can operate property with a slowly-applied, low-actuation force. Such a switch must also be extremely reliable and generate an accurate, repeatable response, while possessing a small actuation differential. These requirements arise perhaps most commonly in applications involving electro-mechanical thermostats, which are utilized for controlling heating and cooling in homes and buildings where coils of standard bi-metal strips form the switch actuation elements. For many years this thermostatic switching function has been performed by mercury bulb switch elements.

Due to the environmental concerns associated with the use of mercury, it is anticipated that electro-mechanical switches will eventually replace mercury-based switches. Legislation currently being drafted and passed in a variety of countries, including the United States, is aimed at banning the use of mercury in most consumer-based applications. Thus, non-mercury based switches must be developed to replace such mercury-type switching mechanisms.

Some attempts have been made at replacing mercury-switching devices, but such attempts have not been very successful. For example, so-called "snap action" switches have been designed to address the environmental concerns that mercury bulb switch elements raise. As utilized herein, the term "snap action switch" generally refers to a low actuation force switch, which utilizes an internal mechanism to rapidly shift or snap the movable contact from one position to another thus making or breaking electrical conduction between the movable contact and a fixed contact in response to moving an operating element of the switch, such as a plunger, a lever, a spring, or the like from a first to a second position. Typically, these switches require only a few millimeters of movement by the operating element to change the conduction state of the switch.

Such switches can safely and reliably operate at a current level of several amperes using the standard 24 VAC power that thermostats control. However, when actuated by a slowly-applied, low-actuation force such as is provided by a thermostat's coiled bi-metal strip, snap action switches may occasionally hang in a state between the two conducting states, or may switch so slowly between the two conducting states that unacceptable arcing and/or heat-rise can occur when entering the non-conducting state. Either condition gives rise to unacceptable reliability and predictability of operation. Furthermore, these switches frequently have unacceptably large differentials, which means that the position of the operating element at which actuation of the switch to one state occurs differs substantially from the position of the actuation element at which actuation of the switch to the other state occurs. If the differential is too large, then the temperature range that the controlled space experiences is also too large. Accordingly, the use of snap action switches in thermostat-type applications has not been particularly successful.

Electronic thermostats are generally known in the art. An example of an electro-mechanical thermostat that has been utilized in commercial, consumer and industrial applications is the T87 thermostat produced by Honeywell International, Inc. ("Honeywell"). An example of the T87 thermostat is disclosed in the publication "Thermostats T87F," Form Number 60-2222-2, S. M. Rev. 4-86, which is incorporated herein by reference. Another example of the T87F thermostat is disclosed in the publication "T87F Universal Thermostat," Form Number 60-0830-3, S. M. Rev. 8-93, which is also incorporated herein by reference. The T87F thermostat, in particular, provides temperature control for residential heating, cooling or heating-cooling systems. U.S. Pat. No. 5,262,752, which is incorporated by reference, is an example of an electrical switch assembly that forms the temperature responsive element in a thermostat.

A typical construction of an electronic thermostat 10 is illustrated in prior art FIG. 1. A processor 15, usually a microprocessor, is connected to a memory 20, a sensor 25, a display 30 and an input/output (I/O) device 35. The processor 15 controls overall operation of the thermostat and produces a control signal, which is generally passed through input/output (I/O) device 35 to the Heating, Ventilating and Air-Conditioning (HVAC) plant for controlling the operation of the plant. The memory 20 stores instructions by which processor 15 operates. Sensor 25 generates a temperature signal representative of the temperature of the air in the vicinity of the sensor 25. Display 30 displays information to an operator of the thermostat. This information may include the current set point, the actual temperature sensed by the sensor 25, the operating status of the HVAC plant and the like.

I/O device 35 receives one or more signals intended for the HVAC plant from the processor 15 and converts such signals into control signals for the HVAC plant. I/O device 35 also receives signals from the HVAC plant and converts those signals into signals which processor 15 can interpret. Electronic thermostats require an external power source to operate. Electro-mechanical thermostats (e.g., the Honeywell T87), on the other hand, control the HVAC plant utilizing only the physical movement of the bi-metal coil. Thus, the successful application of electro-mechanical thermostats is independent of the availability of an adequate power supply. Retrofitting an electronic thermostat into an existing electro-mechanical thermostat installation may require routing and running additional wires from the HVAC plant to the thermostat location.

One of the problems encountered in the efficient utilization of many thermostats in use today is the problem of actuating an electro-mechanical switch with a slow-moving actuator, such as a bi-metal coil, without sacrificing the switch's electrical life. For example, mechanical thermostats, such as the T87 line of thermostats manufactured by Honeywell, utilize a bi-metal coil as the temperature-sensing device. In the operation of the thermostat, the bi-metal coil moves a small amount at a slow rate. Actuating a switch directly off the bi-metal coil results in an inordinate amount of time spent, during the switching cycle, at or near snap-over. Electro-mechanical switches have low contact forces near snap-over and zero contact forces at snap-over. When the switch contact forces are low or zero, the amount of electrical resistance at the contact interface increases. As the electrical resistance to current passing through the switch increases, the heat also increases. The electrical life of an electro-mechanical switch is reduced with time as the current is carried at or near the snap-over points.

The present inventors have thus concluded, based on the foregoing, that a need exists for an improved apparatus, including a method thereof, for effectively actuating or deactuating an electro-mechanical switch. The present invention, which is described in greater detail herein, offers a unique solution to the aforementioned problems.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide an improved electro-mechanical switch.

It is another aspect of the present invention to provide an electro-mechanical switch for use with a thermostat.

It is still another aspect of the present invention to provide a method and apparatus for actuating and deactuating an electro-mechanical switch utilizing an energy-storing actuator.

It is yet another aspect of the present invention to provide a method and apparatus for implementing an electro-mechanical switch which utilizes an energy-storing actuator, without sacrificing the electrical life of the electro-mechanical switch.

It is still another aspect of the present invention to provide for the magnetic opposition/affraction actuation and/or deactuation of a switching device.

The above and other aspects can be achieved as is now described. An apparatus and method for actuating and deactuating an electro-mechanical switch utilizing an energy-storing actuator are disclosed herein. The present invention places magnets on the operating element of the switch (e.g., a lever, which will be used to illustrate the present invention but it is understood that other operating elements will suffice) and on an energy storing actuator, e.g., a bi-metal coil, in a manner in which (1) an opposing force is created when the switch is at its free position and (2) an attracting force when the switch is at is full-over-travel point. Consequently, the switch can be rapidly actuated and deactuated with a slow moving actuator.

An electro-mechanical switch can be configured to include an internal and/or external lever. A first magnet having a first magnetic field thereof is generally located on an internal or external lever of the electro-mechanical switch. A second magnet having a second magnetic field thereof is generally located on an energy-storing actuator, such as a bi-metal coil, wherein the second magnetic field of the second magnet opposes the first magnetic field of the first magnet to form an opposing magnetic force thereof in order to actuate and deactuate the electro-mechanical switch.

The first magnet and the second magnet generally function to resist motion resulting in the stored energy associated with a movement of the energy-storing actuator and the internal or external lever of the electro-mechanical switch. The energy-storing actuator and the lever expend stored energy, which results in a rapid change in geometry thereof, in response to overcoming the opposing magnetic force between the first magnet and the second magnet, such that thereafter the second magnet moves to a position at which the second magnet attracts the first magnet, which is attached to the lever of the electro-mechanical switch.

The electro-mechanical switch then generally moves to a full-over-travel position under an attractive magnetic force formed between the first magnet and the second magnet. Additionally, an attractive magnetic force resists the movement of the energy-storing actuator resulting in a deflection of the energy-storing actuator as the first magnet and the second magnet move with respect to one another, such as apart or away from one another. The energy-storing actuator can thereafter automatically move to an original position thereof to create a magnetic opposing magnetic force to deactuate the electro-mechanical switch when an attractive magnetic force between the first magnet and the second magnet is overcome. The electro-mechanical switch can be configured, for example, as a switch adapted for use with a thermostat.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate an embodiment of the present invention and are not intended to limit the scope of the invention.

Figure 1:
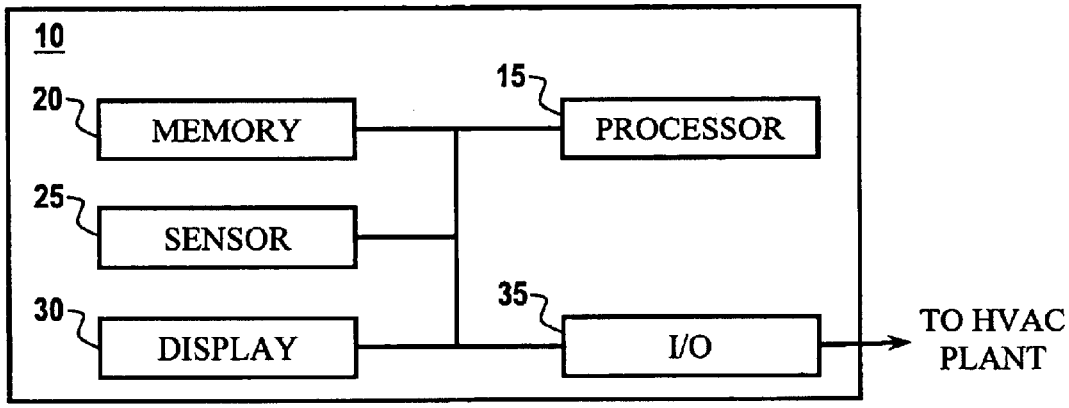
Fig. 1 (Prior Art)
FIG. 1 depicts a block diagram of a prior art electronic thermostat configuration.
Figure 2:
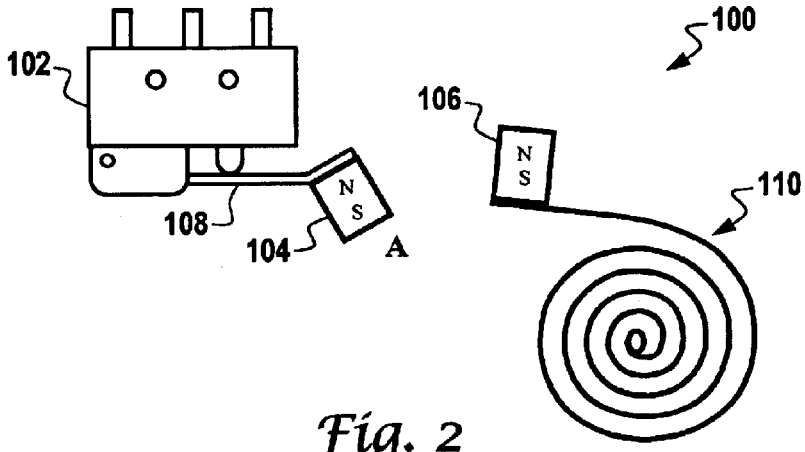
FIG. 2 depicts a schematic diagram of an electro-mechanical switch with a first magnet in a first position in accordance with a preferred embodiment of the present invention.
Figure 3:
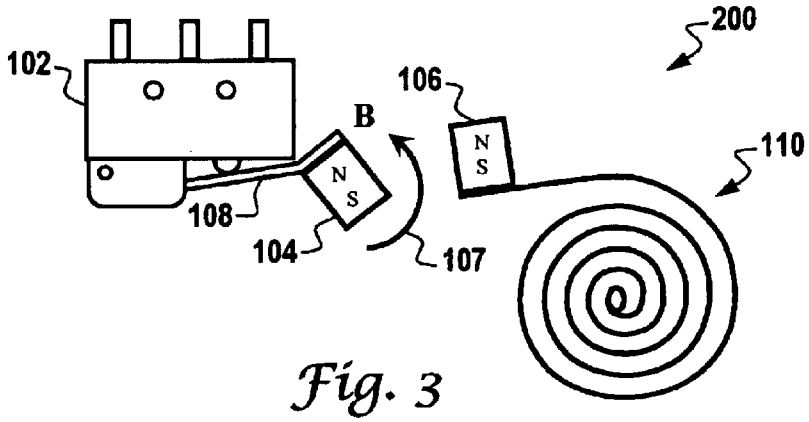
FIG. 3 depicts a schematic diagram of an electro-mechanical switch with a first magnet in a second position in accordance with a preferred embodiment of the present invention.

FIG. 2 depicts a schematic diagram 100 of an electro-mechanical switch 102 with a first magnet 104 in a first position A, in accordance with a preferred embodiment of the present invention. FIG. 3 depicts a schematic diagram 200 of the electro-mechanical switch 102 with the first magnet in a second position B, in accordance with a preferred embodiment of the present invention. The electro-mechanical switch 102 is generally configured to include an operating element (a lever 108 is used for illustrating the present invention although other elements can be used), which may be located external or internal to electro-mechanical switch 102. Note that in FIGS. 2 and 3, like parts are indicated by identical reference numerals.

Additionally, a portion of lever 108 can be placed internal to electro-mechanical switch 102, while another portion of lever 108 can be located external to electro-mechanical switch 102, depending on a desired embodiment. Thus, lever 108 can be configured as a lever that is fully or partially internal and/or external to electro-mechanical switch 102. The first magnet 104 can be located on lever 108, such as at an end of lever 108 as shown, and includes a first magnetic field thereof. A second magnet 106 having a second magnetic field thereof is generally located on an energy-storing actuator 110 (e.g., a bi-metal coil), wherein the second magnetic field of the second magnet 106 opposes the first magnetic field of the first magnet 104 to form an opposing magnetic force thereof in order to actuate and deactuate the electro-mechanical switch 102.

The first magnet 104 and the second magnet 106 generally function to store energy associated with a movement of the energy-storing actuator 110 and the lever 108 of the electro-mechanical switch 102. The energy-storing actuator 110 and the lever 108 expend stored energy, which results in a rapid change in geometry thereof, in response to overcoming the opposing magnetic force between the first magnet 104 and the second magnet 106. Thereafter, the second magnet 106 moves to a position at which the second magnet 106 attracts the first magnet 104, which is attached to the lever 108 of the electro-mechanical switch 102.

The electro-mechanical switch 102 then moves to a full-over-travel position under an attractive magnetic force formed between the first magnet 104 and the second magnet 106. Additionally, an attractive magnetic force resists the movement of the energy-storing actuator 110 resulting in a deflection of the energy-storing actuator 110 as the first magnet 104 and the second magnet 106 move apart or away from one another. The energy-storing actuator 110 can thereafter automatically move to an original position thereof to create an opposing magnetic force to deactuate the electro-mechanical switch 102 when an attractive magnetic force between the first magnet 104 and the second magnet 106 is overcome. The electro-mechanical switch 102 can be configured, for example, as a switch adapted for use with a mechanical thermostat, such as for example, the Honeywell T87 thermostat, which is described herein.

The movement of magnet 104 is indicated by arrow 107, thus illustrating the movement from position A to position B. However, it should be understood that other movements are possible such as side-to-side and otherwise. Note that FIG. 2 generally illustrates a configuration in which magnets 104 and 106 are repelling in the orientation with respect to position A. As the energy-storing actuator 110 (e.g., bi-metal coil) is subjected to lower/cooler temperatures, its movement is stored until the magnetic repulsion is overcome. In the orientation of FIG. 2, the electro-mechanical switch 102 is located in its "free" position. In FIG. 3, however, the magnets are indicated attracting in this orientation. As the energy-storing actuator 110 (e.g., bi-metal coil) is subjected to higher/hotter temperatures and expands, its movement is stored until the magnetic attraction is overcome. In the orientation of FIG. 3, the electro-mechanical switch 102 is in its full-over-travel position.

The present invention solves the problem of actuating an electro-mechanical switch with a slow-moving actuator, such as a bi-metal coil, without sacrificing the switch's electrical life. For example, mechanical thermostats, such as the Honeywell T87 line of thermostats, utilize a bi-metal coil as the temperature-sensing device. In the operation of the thermostat, the bi-metal coil moves a small amount at a slow rate. Actuating a switch directly off of the bi-metal coil results in an inordinate amount of time spent, during the switching cycle, at or near snap-over. Electro-mechanical switches have low contact forces near snap-over and zero contact forces at snap-over. When the switch contact forces are low or zero, the amount of electrical resistance at the contact interface increases. As the electrical resistance to current passing through the switch increases, the heat created by I^2R heating also increases. The electrical life of an electro-mechanical switch is reduced with time as the current is carried at or near the snap-over points.

Those skilled in the art can thus appreciate that the aforementioned problem can be solved, in accordance with the present invention, by positioning magnets on a switch's (internal or external) lever and on an energy-storing actuator (e.g., a bi-metal coil) in a manner that creates an opposing force when the switch is at its free position and an attracting force when the switch is at its full-over-travel point. It is thus possible to rapidly actuate and deactuate the switch with a slow moving actuator. In the application of the switch in a mechanical thermostat, the opposed magnets store the energy of the bi-metal coil's movement in deflections of the bi-metal coil and the switch's lever.

Once the magnetic opposing force is overcome, the bi-metal coil and switch's lever expend the stored energy, resulting in rapid change in geometry. The magnet on the bi-metal coil suddenly moves to a position at which it attracts the magnet attached to the switch's lever. Under magnetic attraction, the switch's lever is moved to its full-over-travel position. As the two magnets deflect each other, the attractive force again resists the bi-metal coil's movement resulting in a deflection of the bi-metal coil. Once the attractive force is overcome, the coil suddenly moves to its original position, creating a magnetic opposing force that deactuates the switch.

Figure 4:
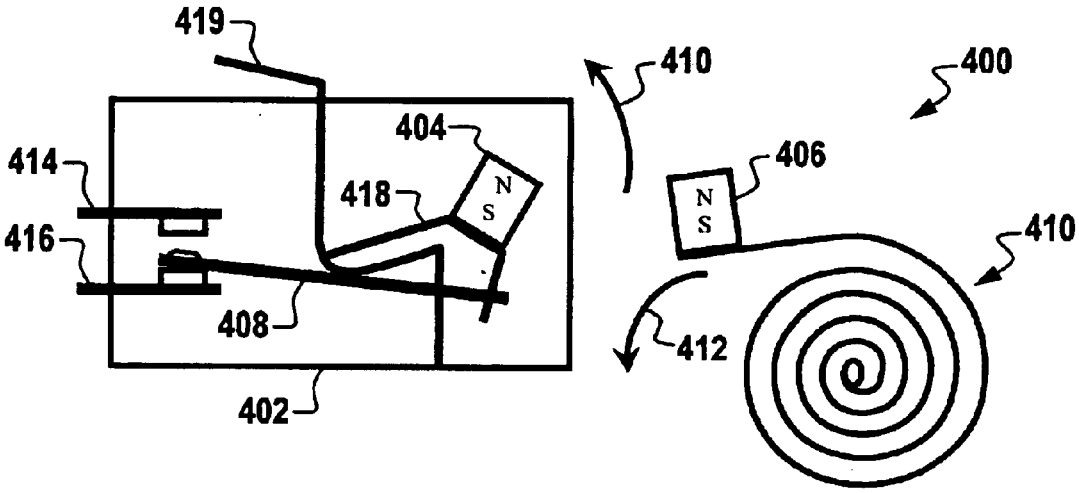
FIG. 4 depicts a schematic diagram of an electro-mechanical switch having an internal lever in a first position in accordance with an alternate embodiment of the present invention.
Figure 5:
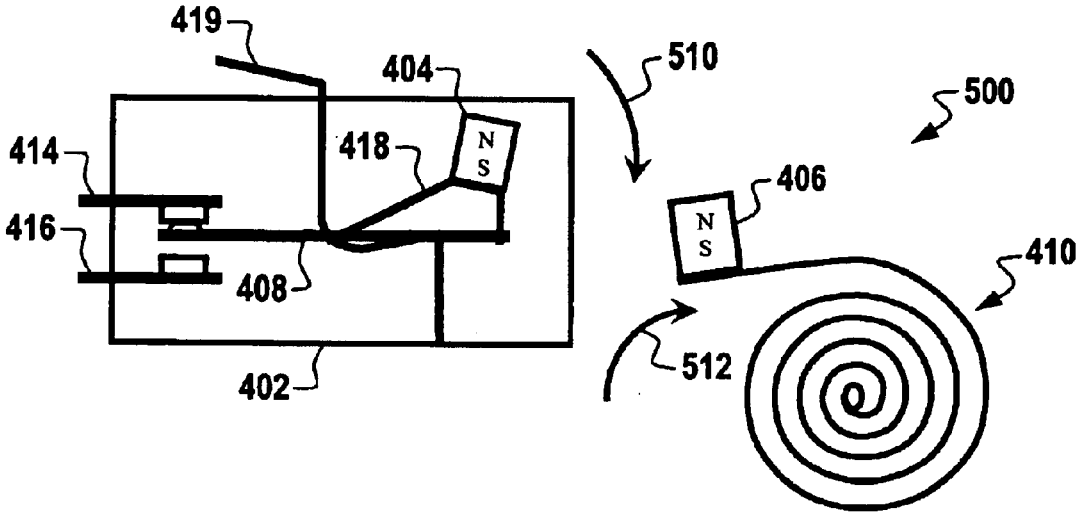
FIG. 5 depicts a schematic diagram of an electro-mechanical switch having an internal lever in a second position in accordance with an alternate embodiment of the present invention.

FIG. 4 depicts a schematic diagram 400 of an electro-mechanical switch having an internal lever in a first position, in accordance with an alternate embodiment of the present invention. FIG. 5 depicts a schematic diagram 500 of an electro-mechanical switch having an internal lever in a second position in accordance with an alternate embodiment of the present invention. In FIGS. 4 and 5 like parts are indicated by identical reference numerals. An electro-mechanical switch 402 includes a common terminal 419 and a spring 40 as the operating element, which support a platform 418 upon which a first magnet 404 is located. Electro-mechanical switch 402 also includes a normally open (NO) stationary terminal 414 and a normally closed (NC) stationary terminal 416. In operation, the position of spring element 408 can be either at the NC stationary terminal 416 or the NO stationary terminal 414, depending on the position of platform 418. An energy-storing actuator 410 is generally located proximate to electro-mechanical switch 402. The energy-storing actuator 410 has a second magnet 406 located at on energy-storing actuator 410, such as at an end as shown in FIG. 5. The energy-storing actuator 410 of FIGS. 4 and 5 is analogous to the energy-storing actuator 110 of FIGS. 2 and 3. Energy-storing actuator 410 can be configured as a bi-metal coil.

In the configuration depicted in FIG. 4, magnets 404 and 406 are shown repulsing one another. Once the energy-storing actuator 410 (e.g., bi-metal coil) has cooled and stored enough energy to overcome the magnetic repulsion, the bi-metal of the bi-metal coil rapidly moves down and to the left such that the internal lever 408 of electro-mechanical switch 402 rapidly moves from its free position to its full-over-travel position, as indicated by arrows 410 and 412. In the configuration depicted in FIG. 5, magnets 404 and 406 are shown attracting one another. Once the energy-storing actuator 410 (e.g., bi-metal coil) has warmed and stored enough energy to overcome the magnetic attraction, the bi-metal of the bi-metal coil will rapidly move up and to the right and internal lever 408 of the electro-mechanical switch 402 will move from its full-over-travel position to its free position as indicated by arrows 510 and 512.

The present invention offers several useful advantages. For example, the apparatus and method of the present invention can be implemented in a manner that utilizes the opposing magnets to achieve a quick actuating motion with no physical contact between the actuating device and the switching device. This effectively eliminates the unpredictable effects of friction between two moving parts in a force/travel sensitive system. In addition, it allows the switch to be more easily enclosed to protect it from the degradation of the environment.

Another advantage of the present invention stems from the utilization of the affraction/repulsion properties of the magnetic field between two magnets to create a quick actuating/deactuating motion. The movement and interaction of the magnets provides a level of hysteresis in the system that is desirable to prevent accidental actuation/deactuation sequences in a shock and vibration environment. In essence, the present invention compartmentalizes the components into a switch and an actuator, such that no additional hardware is necessary. This simplifies the assembly method and lowers the unit cost.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The embodiments of an invention in which an exclusive property or right is claimed are defined as follows:

1. A magnetically-driven snap action switch apparatus, said apparatus comprising:

an electro-mechanical switch having an operating element;

a first magnet having a first magnetic field thereof, wherein said first magnet is located on said operating element;

a second magnet having a second magnetic field thereof located on a slow-moving energy-storing actuator, such that an opposing magnetic force is created when said electro-mechanical switch is at a free position thereof and an attracting magnetic force is created when said electro-mechanical switch is at a full-over-travel point thereof; and wherein said second magnetic field of said second magnet opposes said first magnetic field of said first magnet to form said opposing magnetic force thereof in order to actuate and deactuate said electro-mechanical switch.

2. The apparatus of claim 1 wherein said first magnet and said second magnet resist movement of, and result in the storage of energy in, said slow-moving energy-storing actuator and said operating element.

3. The apparatus of claim 1 wherein said slow-moving energy-storing actuator and said operating element expend stored energy which results in a rapid change in geometry thereof in response to overcoming said opposing magnetic force between said first magnet and said second magnet, such that thereafter said second magnet moves to a position at which said second magnet attracts said first magnet to said operating element.

4. The apparatus of claim 1 wherein said electro-mechanical switch moves to said full-over-travel position under an attractive magnetic force formed between said first magnet and said second magnet.

5. The apparatus of claim 1 wherein an attractive magnetic force resists the movement of said energy-storing actuator resulting in a deflection of said slow-moving energy-storing actuator as said first magnet and said second magnet move with respect to one another.

6. The apparatus of claim 1 wherein said energy-storing actuator moves to an original position thereof to create an opposing magnetic force to deactuate said electro-mechanical switch when an attractive magnetic force between said first magnet and said second magnet is overcome.

7. The apparatus of claim 1 wherein said slow-moving energy-storing actuator comprises a bi-metal coil.

8. The apparatus of claim 1 wherein said electro-mechanical switch comprises a switch adapted for use with a mechanical thermostat.

9. The apparatus of claim 1 wherein said first magnet is located at an end of said operating element.

10. The apparatus of claim 1 wherein said operating element comprises an internal lever of said electro-mechanical switch.

11. The apparatus of claim 1 wherein said operating element comprises an external lever of said electro-mechanical switch.

12. The apparatus of claim 10 wherein:

said first magnet and said second magnet resist movement of, and result in the storage of energy in, said energy-storing actuator and said operating element; and wherein said energy-storing actuator and said operating element expend stored energy which results in a rapid change in geometry thereof in response to overcoming said opposing magnetic force between said first magnet and said second magnet, such that thereafter said second magnet moves to a position at which said second magnet attracts said first magnet to said operating element.

13. A magnetically-driven snap action switch apparatus, said apparatus comprising:

an electro-mechanical switch having an operating element, wherein said electro-mechanical switch comprises a switch adapted for use with a mechanical thermostat;

a first magnet having a first magnetic field thereof, wherein said first magnet is located on said operating element; and a second magnet having a second magnetic field thereof located on an energy-storing actuator, wherein said energy-storing actuator comprises a bi-metal coil and wherein said second magnetic field of said second magnet opposes said first magnetic field of said first magnet to form an opposing magnetic force thereof in order to actuate and deactuate said electro-mechanical switch.

14. The apparatus of claim 13 wherein an attractive magnetic force resists the movement of said energy-storing actuator resulting in a deflection of said energy-storing actuator as said first magnet and said second magnet move with respect to one another.

15. The apparatus of claim 13 wherein said energy-storing actuator moves to an original position thereof to create a magnetic opposing magnetic force to deactuate said electro-mechanical switch when an attractive magnetic force between said first magnet and said second magnet is overcome.

16. A magnetically-driven snap action switch apparatus, said apparatus comprising:

an electro-mechanical switch having an operating element, wherein said electro-mechanical switch comprises a switch adapted for use with a mechanical thermostat;

a first magnet having a first magnetic field thereof, wherein said first magnet is located on said operating element;

a second magnet having a second magnetic field thereof located on a slow-moving energy-storing actuator, wherein said slow-moving energy-storing actuator comprises a bi-metal coil and wherein said second magnetic field of said second magnet opposes said first magnetic field of said first magnet to form an opposing magnetic force thereof in order to actuate and deactuate said electro-mechanical switch wherein said first magnet and said second magnet resist movement of, and result in the storage of energy in, said slow-moving energy-storing actuator and said operating element and wherein said slow-moving energy-storing actuator and said operating element expend stored energy which results in a rapid change in geometry thereof in response to overcoming said opposing magnetic force between said first magnet and said second magnet, such that thereafter said second magnet moves to a position at which said second magnet attracts said first magnet to said operating element;

wherein an attractive magnetic force resists the movement of said slow-moving energy-storing actuator resulting in a deflection of said slow-moving energy-storing actuator as said first magnet and said second magnet move with respect to one another; and wherein said slow-moving energy-storing actuator moves to an original position thereof to create an opposing magnetic force to deactuate said electro-mechanical switch when an attractive magnetic force between said first magnet and said second magnet is overcome.

17. The apparatus of claim 16 wherein said operating element comprises an internal lever of said-electro-mechanical switch.

18. The apparatus of claim 16 wherein said operating element comprises an external lever of said electro-mechanical switch.

* * * * *